United States Patent [19]

Grace

[11] Patent Number: 4,555,927

[45] Date of Patent: Dec. 3, 1985

[54] APPARATUS FOR STRAIGHTENING VEHICLE STRUCTURAL PART

[76] Inventor: William G. Grace, 6263 Staheli Dr., Kelseyville, Calif. 95451

[21] Appl. No.: 598,773

[22] Filed: Apr. 11, 1984

[51] Int. Cl.[4] ..... B21D 1/14

[52] U.S. Cl. ..... 72/447; 72/705

[58] Field of Search ..... 72/705, 447

[56] References Cited

U.S. PATENT DOCUMENTS

| | | | |
|---|---|---|---|
| 2,542,836 | 2/1951 | Porter et al. | 72/705 |
| 3,122,194 | 2/1964 | Bronson et al. | 72/705 |
| 3,292,410 | 12/1966 | Baldassano | 72/705 |
| 3,626,747 | 12/1971 | Rouis | 72/705 |
| 3,927,550 | 12/1975 | Samuelsson | 72/705 |
| 4,158,303 | 6/1979 | Horn et al. | 72/705 |

FOREIGN PATENT DOCUMENTS

| | | | |
|---|---|---|---|
| 249933 | 10/1963 | Australia | 72/705 |
| 2420248 | 11/1975 | Fed. Rep. of Germany | 72/705 |

*Primary Examiner*—Lowell A. Larson

*Attorney, Agent, or Firm*—Townsend and Townsend

[57] ABSTRACT

Apparatus for straightening structural parts, such as vehicle parts which can be removed from a vehicle and straightened after being bent out of shape due to a collision with another object. The apparatus includes a table on which the structural part can be mounted. The table has first and second center bars in adjacent horizontal planes, the center bars being movable relative to the table into any one of a number of operative positions. At least one outer end of each center bar is provided with means for adjustably mounting a fluid actuated power device, each power device being coupled to an upright post, whereby a chain, cable or rod can be coupled between the post and a structural part for applying a pulling force to the structural part for returning the structural part to its normal operative shape. The apparatus is substantially self-contained in that the power sources for operating the power devices can be foot or hand actuated compressors for applying pressurized fluid to the power devices. The apparatus is especially suitable for straightening frame extensions, impact bars and side brackets of Chevrolet Corvette automobiles.

10 Claims, 7 Drawing Figures

FIG. 7
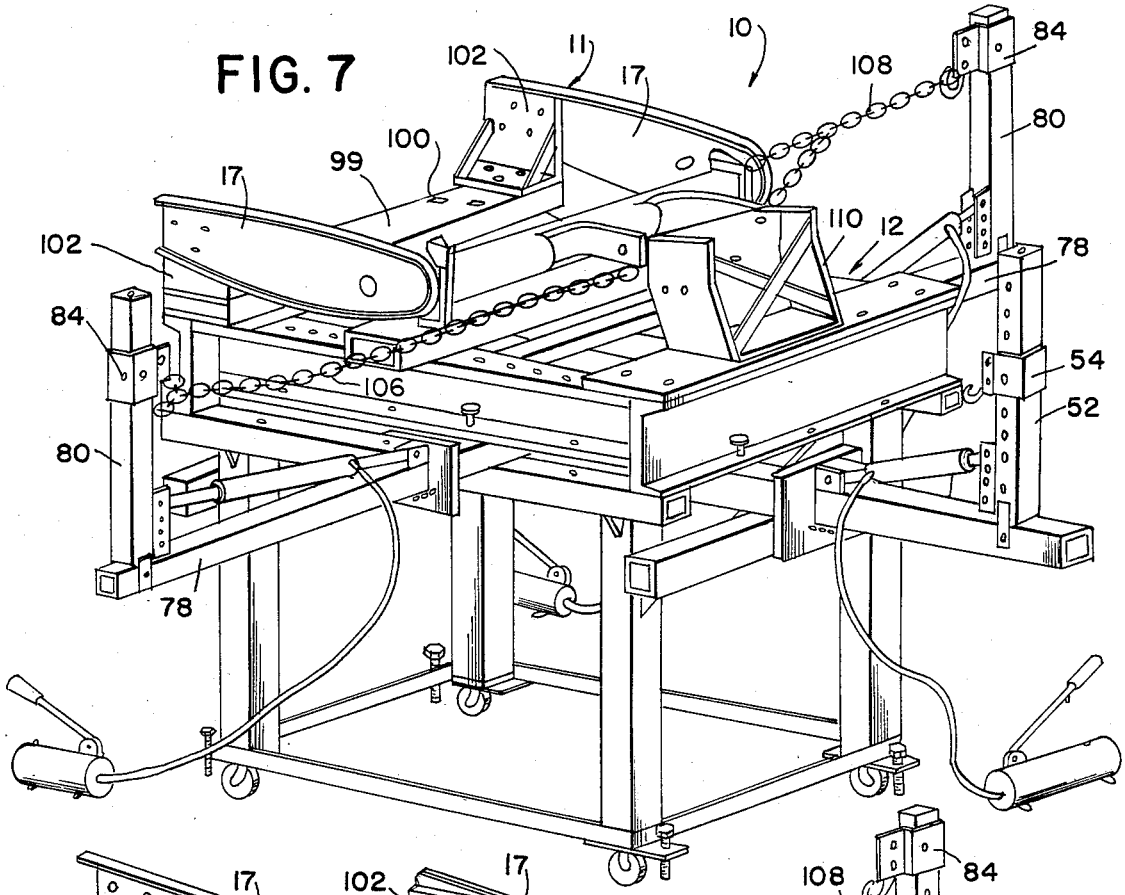
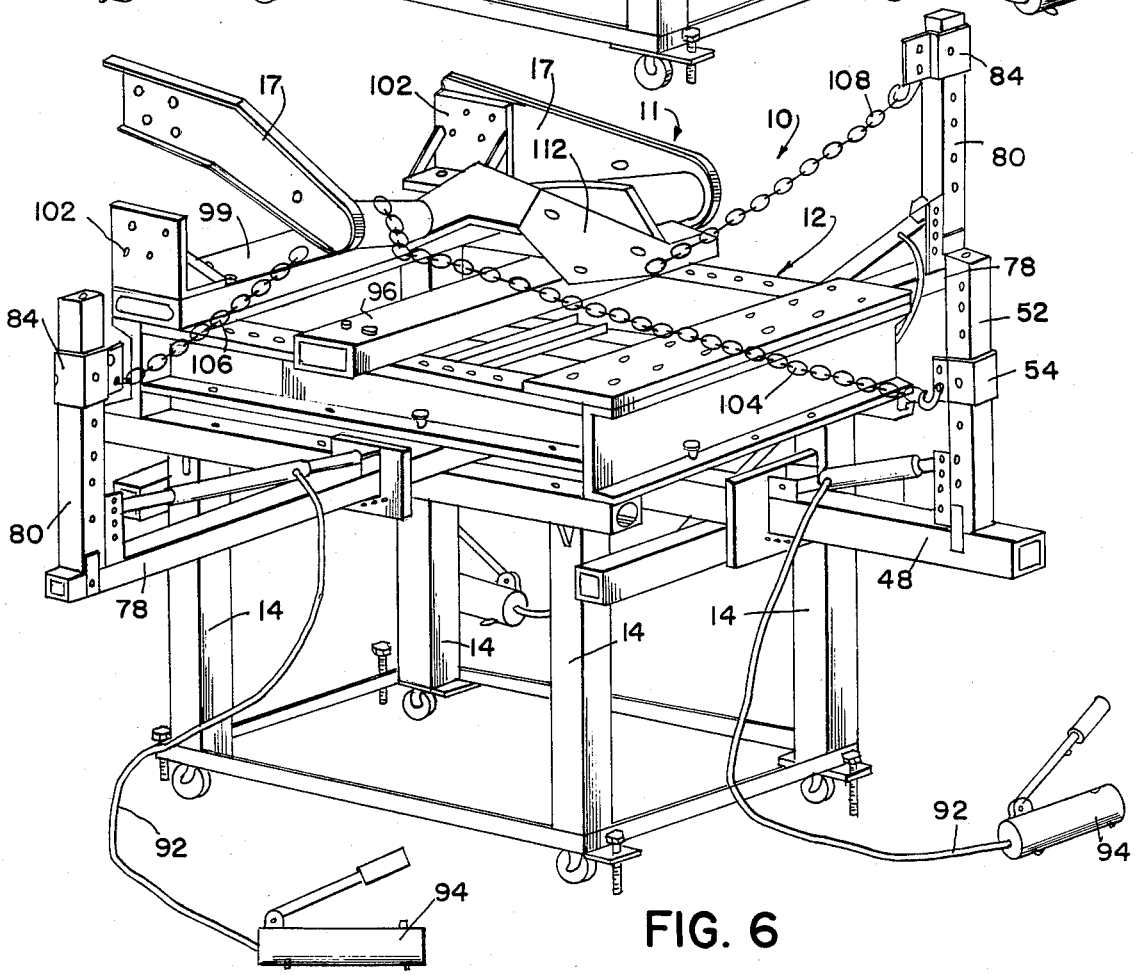
FIG. 6

APPARATUS FOR STRAIGHTENING VEHICLE STRUCTURAL PART

This invention relates to improvements in machines for straightening metallic parts of different types and shapes and, more particularly, to an improved apparatus for straightening rigid, metallic parts which have been bent out of shape and require a large force to return them to their original shapes.

BACKGROUND OF THE INVENTION

Machines have been known and used in the past for straightening the frames of vehicles after the vehicles have been involved in collisions. Generally, this requires that a vehicle be moved onto a rack or other platform where the frame of the vehicle is accessible to devices on the outer periphery of the platform for applying pulling forces to the vehicle frame. These machines are complex in construction, require a large amount of space, and are expensive to produce and maintain. Representative disclosures relating to vehicle frame straightening machines include the following U.S. Pat. Nos.:

3,340,720
4,088,006
4,271,692
4,296,626
4,309,894
4,336,705

The machines of the type d.escribed above are typically not suitable for straightening parts of vehicles, such as parts which can be removed from the vehicle. Such structural parts are of relatively small size and cannot be adequately handled on frame straightening machines without major modifications. A representative vehicle having structural parts at its front end which are typically bent out of shape in a collision is a Chevrolet Corvette. It has a frame extension, an impact bar and a pair of side brackets near the frame extension, all of which are bent or twisted out of shape when the vehicle strikes an object with its front end, such as during a collision with another vehicle. These parts of the vehicle can be separated from the vehicle itself since the parts are bolted to the frame or other mounting supports; however, machines for straightening vehicle frames are not adapted to accommodate parts of these types.

In the past, relatively small structural parts, once they have become damaged due to collisions, have merely been thrown away and replaced with new parts. However, this practice has been found not to be economical, assuming the parts can be returned to their original shapes. Thus, a need exists for a machine for straightening parts of these types and the present invention satisfies this need.

SUMMARY OF THE INVENTION

The present invention is directed to an apparatus comprised of a table having means thereon for mounting a structural part to be straightened. The table is movable from place to place so that it can be positioned at a most convenient location for straightening a particular part. The table has first and second center bars which are adjustably provided with extension bars at their outer ends, the extension bars being used to mount fluid actuated power devices which can exert outwardly directed mechanical forces on a structural part by way of chains, cables or rods. In this way, forces in various directions and at different angles can be exerted on a structural part which is releasably mounted on the table so that the part can be bent back into its normal, operative shape in a minimum of time and with minimum expenditure of power.

The apparatus of the present invention is essentially self-contained in that the source of power for each power device can be a hand or foot actuated compressor for pressurizing a fluid. In this way, no additional outside power sources are necessary and structural parts of different sizes and shapes can be straightened without requiring special skills on the part of the user of the apparatus.

The primary object of the present invention is to provide an improved apparatus for straightening metallic structural parts of different sizes and shapes wherein the apparatus includes a table having means thereon for mounting a part to be straightened and power actuated devices for exerting pulling forces on the structural part with the forces being adjustable in direction and location with respect to the structural part whereby a combination of forces can be exerted on the structural part to be straightened in such a manner that the straightening of the part can proceed quickly and easily and without the expenditure of any manual effort.

Other objects of this invention will become apparent as the following specification progresses, reference being had to the accompanying drawings for an illustration of the invention.

IN THE DRAWINGS:

FIG. 6 is a view similar to FIG. 1 but showing a structural part on the apparatus before the structural part has been straightened; and FIG. 7 is a view similar to FIG. 6 but showing the structural part after it has been straightened on the apparatus.

Figure 1:
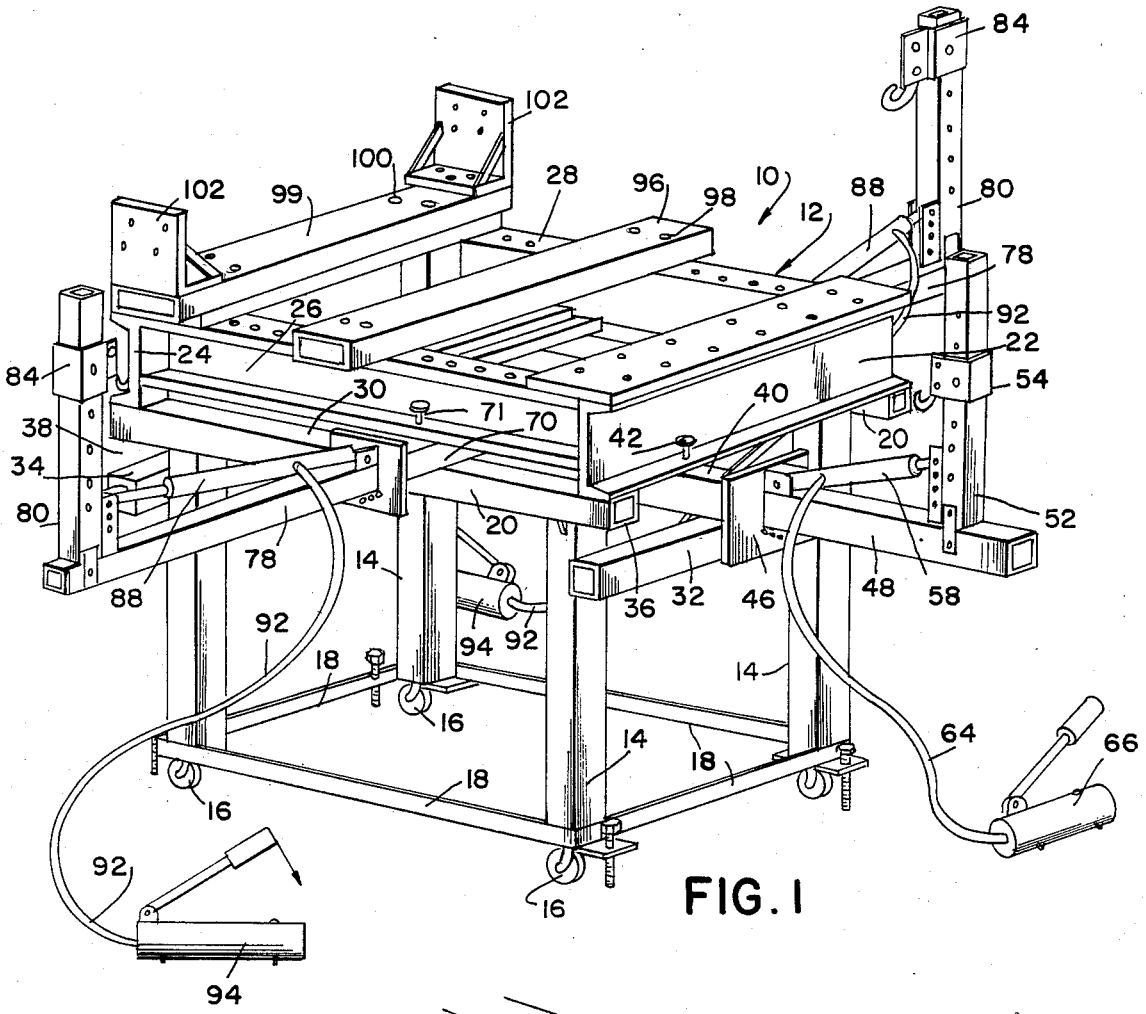
FIG. 1 is a perspective view of the apparatus of the present invention for use in straightening vehicle parts.
Figure 5:
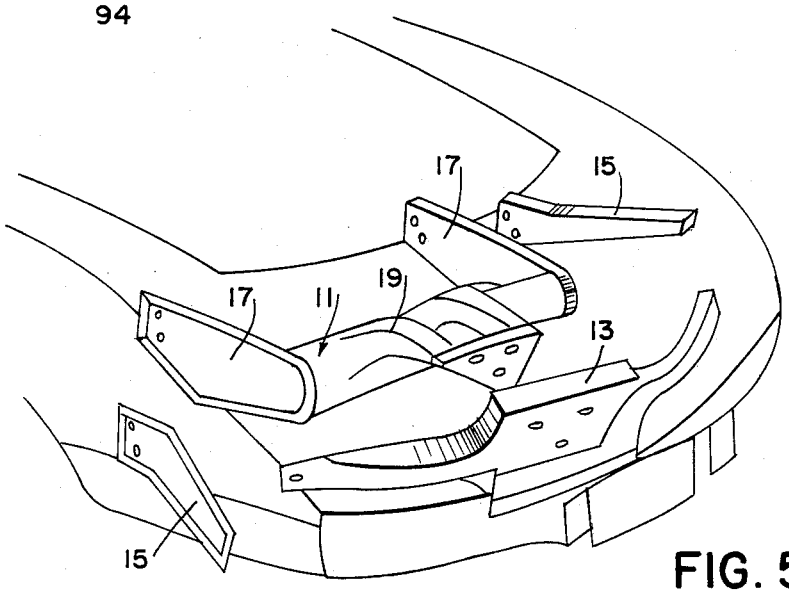
FIG. 5 is a perspective view of three different structural parts of a vehicle which can be straightened with the apparatus of the present invention.
Figure 2:
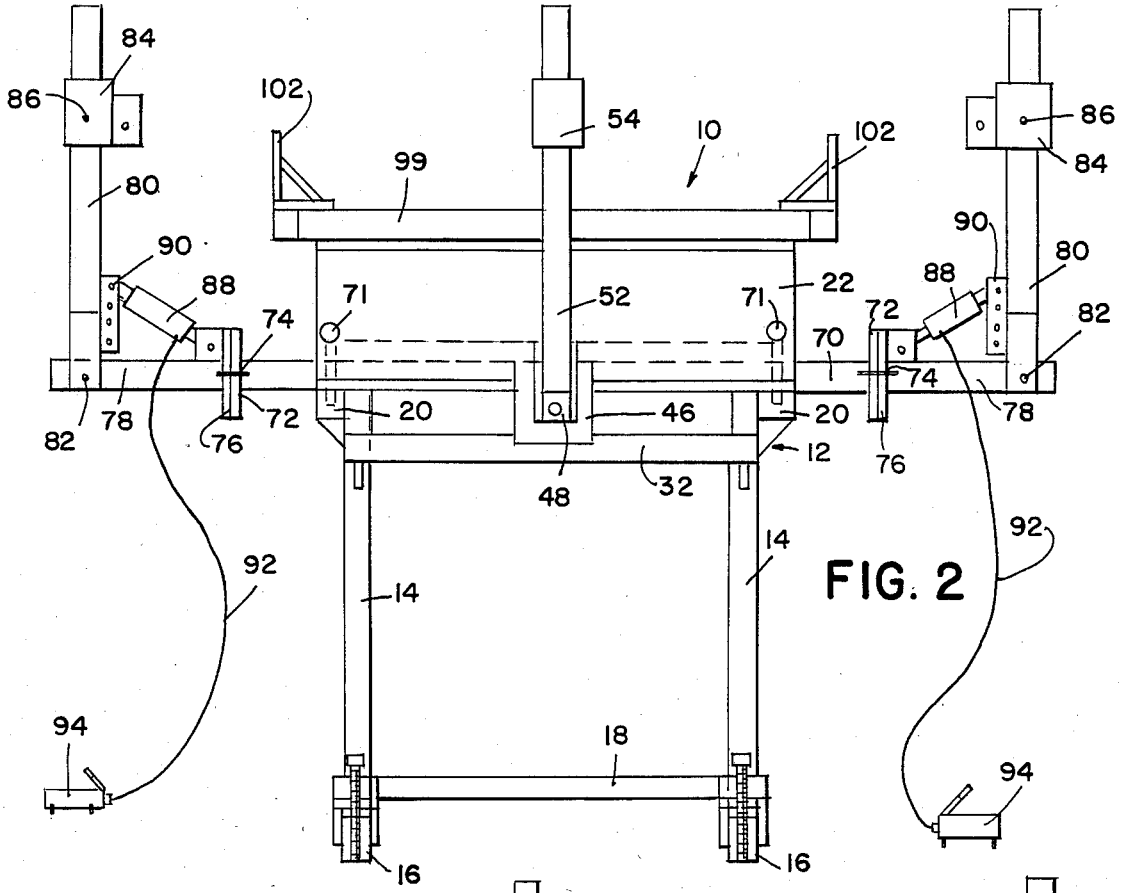
FIG. 2 is a front elevational view of the apparatus.

The apparatus of the present invention is broadly denoted by the numeral 10 and is shown in its assembled form in FIG. 1. Apparatus 10 is suitable for straightening a number of different structural parts of a vehicle. For purposes of illustration, FIG. 5 shows three different types of structural parts of a vehicle which can be straightened with apparatus 10. FIG. 5 shows a Chevrolet Corvette which has a frame extension 11, an impact bar 13 and a pair of angled side brackets 15. These structural parts are located at the front of the vehicle and are generally bent out of shape when the front end impacts on another object, such as another vehicle when a rear-end collision occurs. Rather than purchase new structural parts, it is found to be more economical to straighten frame extension 11, impact bar 13 and side brackets 15 since these parts generally are still usable, i.e., they have not been damaged beyond repair, although welds at certain joints may be required to provide the necessary strength characteristics.

For example, frame extension 11 has a pair of side members 17 coupled to the ends of a crosspiece 19. Generally, the side members 17, following a collision with another vehicle, will be twisted or bent out of position, requiring the frame extension 11 to be bent so that the side members once again are parallel with each other and are in the proper relationship with respect to the crosspiece 19. It is the purpose of apparatus 10 to cause the straightening of a structural part, such as frame extension 11, so that it can be used as a replacement part on the same vehicle it was removed from or on a different vehicle, whichever is desired.

Apparatus 10 includes a table 12 having a number of legs 14, there being four legs shown in FIG. 1 for purposes of illustration. Each leg has a caster 16 on the lower end thereof, and braces 18 interconnect adjacent legs to stabilize the table. The casters allow the table to be moved over a supporting surface so that the table can be placed in the most convenient location for working on structural parts to be straightened. The lengths of the legs are such that the upper extremity of the table typically is waist-high so that a person using the apparatus can stand on the supporting surface while making the necessary connections and adjustments to the elements of the table.

Figure 3:
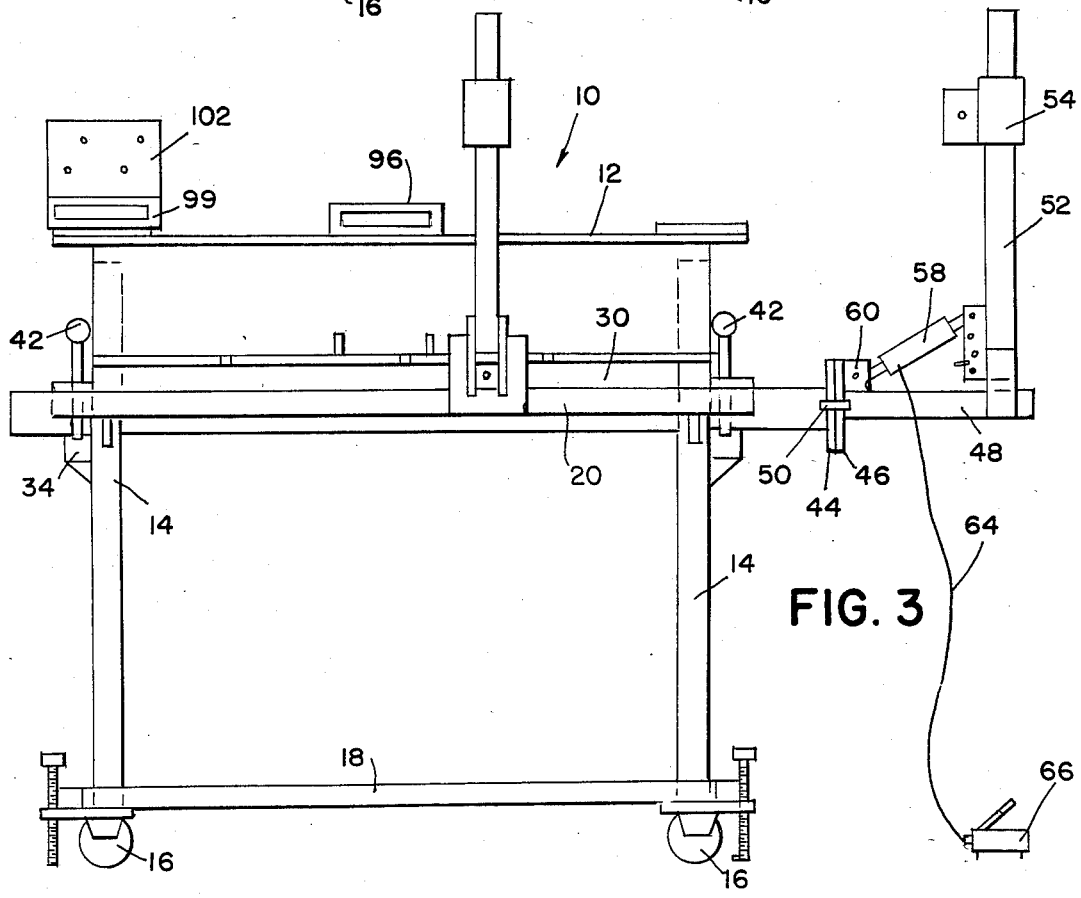
FIG. 3 is a side elevational view of the apparatus.
Figure 4:
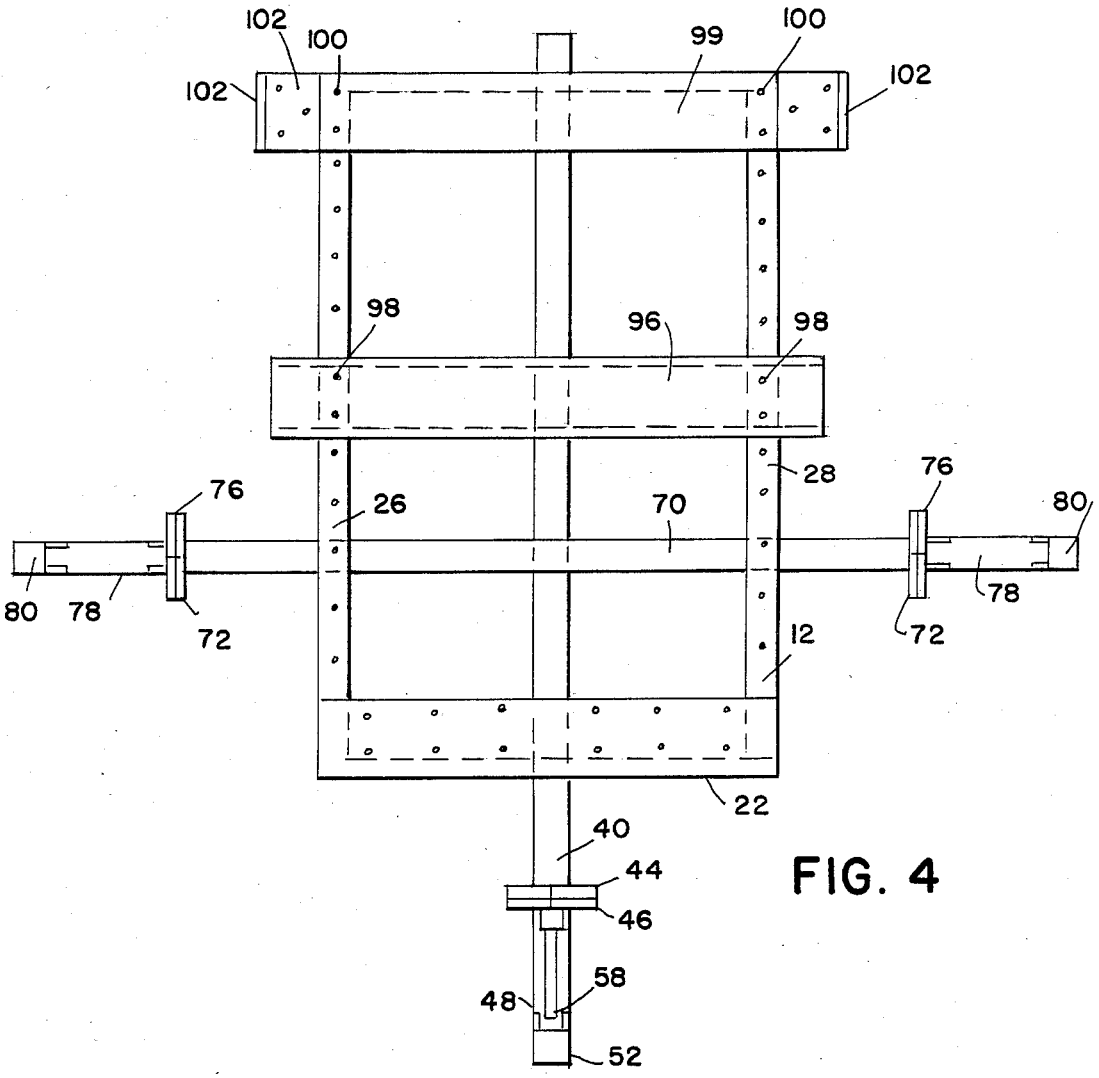
FIG. 4 is a top plan view of the apparatus.

The table further includes a pair of generally parallel side support members 20 secured and spanning the distance between a pair of adjacent legs 14. A front beam 22 is secured to first ends of side members 20 and a rear beam 24 is secured to the opposite ends of side members 20. A pair of side beams 26 and 28 are secured to and span the distance between respective ends of front and rear beams 22 and 24. Each of the side beams 26 and 28 is spaced above the corresponding side member 20 so that a gap 30 is formed as shown in FIG. 3.

Table 12 further includes a front support member 32 and a rear support member 34. Members 32 and 34 are spaced below front and rear beams 22 and 24, respectively, to present gaps 36 and 38, respectively.

A first center bar 40 is shiftably mounted on table 12 and spans the distance between front and rear members 32 and 34. Bar 40 has its front end projecting through gap 36 and its rear end (FIG. 3) projecting through gap 38. Bar 40 can be releasably secured by pins 42 to front beam 22 and rear beam 24. By virtue of pins 42, bar 40 can extend parallel to side members 20 or can be at an angle with respect thereto while remaining in a generally horizontal plane and in sliding engagement with the upper surfaces of front and rear members 32 and 34.

The front end of bar 40 has a plate 44 (FIG. 3) thereon. This plate mates with a second plate 46 on the rear end of an extension bar 48 which extends forwardly from bar 40 when plates 44 and 46 are releasably interconnected by at least a pair of bolts 50.

An upright post 52 is pivotally secured to bar 48 near its front end. Post 52 has an attachment bracket 54 thereon for receiving a chain or cable for use in pulling on a structural part to be straightened with the use of apparatus 10. Upright post 52 is pivotally mounted by a pin 56 on the front end of bar 48, whereby post 52 can pivot about the axis of pin 56.

A fluid actuated piston and cylinder assembly 58 is secured at one end to a bracket 60 secured to plate 46. The opposite of the cylinder 58 is adjustably coupled to a rigid strip 62 having holes therethrough. Thus, the angle at which the cylinder is mounted can be varied. A fluid line 64 leading to a source of power, such as a foot-actuated compressor 66, supplies fluid under pressure to the cylinder to cause pivoting of bar 52 in a clockwise sense relative to bar 48 when viewing FIG. 3. A chain or cable coupled at one end to bracket 54 can then be put under tension to provide a pulling force on a structural part coupled to the opposite end of the chain or cable.

Bar 40 is shown as projecting outwardly from the front of the table. If desired, bar 40 can be removed from its position shown in FIG. 1 and then inserted from the rear of the table and pinned as before. Thus, this feature allows pull in a 360° arc around the table.

A second center bar 70 is carried on table 12 in a horizontal plane above the horizontal plane in which first center bar 40 moves. Center bar 70 has its ends projecting through and outwardly of gaps 30. Center bar 70 is supported on and can be releasably coupled by pins 71 5o support members 20. The outer ends of center bar 70 have end plates 72 thereon for releasable and adjustable attachment by bolts 74 to end plates 76 on the inner ends of extension bars 78 which project outwardly from opposed sides of table 12. Each extension bar 78 has an upright post 80 pivotally mounted by a pin 82 near the outer end thereof. Each upright post 80 has an attachment bracket 84 thereon which is adjustably mounted by a pin 86 on the post 80, whereby a chain, cable or rod can be coupled to post 80 for use in straightening a structural part mounted on table 12. A fluid piston and cylinder assembly 88 is pivotally secured at one end on the corresponding end plate 76 and at the other end, the assembly 88 is adjustably mounted by a pin on a rigid strip 90 secured to the corresponding upright post 80. A fluid delivery line 92 couples piston and cylinder assembly 88 with a compressor 94 which is hand or foot operated. While a pair of upright posts 80 are shown with table 12, it may be possible that only a single upright post for straightening a particular type of part, depending upon the extent of damage to the part itself.

When mounting a part on the table 12, the part can be secured thereon at any suitable location. For purposes of illustration, a center beam 96 is removably attached by bolts 98 to side beams 26 and 28. An end beam 99 is secured by bolts 100 to rear beam 24; thus, front beam 22, center beam 96 and rear beam 99 can be used for mounting the part to be straightened. All three of these beams can be provided with holes or brackets for mounting them to the structural part, beam 99 being shown with end brackets 102 which are rightangle brackets and have holes therein for mounting adjacent portions of a structural part.

In use, a structural part to be straightened is mounted on table 12 in any suitable manner. For purposes of illustration, FIG. 6 shows a frame extension 11 (FIG. 5) which is twisted out of normal shape and is to be straightened by the use of apparatus 10. In the particular embodiment of the frame extension, one side member 17 is secured by bolts to a bracket 102 so that the frame extension is substantially rigid with respect to frame 12, yet the frame extension can be bent into its proper shape by the application of pulling forces caused by the operation of fluid piston cylinder assemblies 58 and 88.

FIG. 6 shows a first chain 104 securing bracket 54 of upright post 52 to the crosspiece 19 of frame extension 11. A second chain 106 secures the bracket 84 of one of the side, upright posts 80 to the free side member 17 of the frame extension 11. A third chain 108 secures the bracket 84 of the other side bar 80 to the central portion of crosspiece 19. Generally, the locations and angles of first and second center bars 40 and 70 will initially be preset as will the angularity of upright posts 52 and 80 and the heights of brackets 54 and 84. The adjustment of these elements of table 12 will be made as determined from experience and by observation as to how the structural part to be straightened is responding to the pulling forces exerted on the various chains 104, 106 and 108. The forces on the chains are caused by the operation of the compressors 66 and 94, and the forces are progressive in the sense that a greater or lesser amount of force is exerted on the chains with reference to each other. In this way, the structural part, such as frame extension 11, is bent back into its normal shape, and the frame extension eventually will assume the normal shape shown in FIG. 7. FIG. 7 also shows a bracket 110 which may be attached to beam 22 and coupled to the front plate 112 of crosspiece 19 for use in straightening the frame extension 11.

When the structural part is completely straightened to the satisfaction of the user of apparatus 10, the forces exerted by chains 104, 106 and 108 are removed, thereby permitting removal of the structural part from table 10. The table can then be used for straightening another part.

What is claimed is:

1. Apparatus for straightening a structural part comprising:

a table having an upper surface means for supporting a structural part to be straightened;

means on the table for releasably mounting a structural part to be straightened;

a first central bar shiftably mounted on the table for movement in a first plane into in any one of a number of fixed, operative positions;

means releasably securing the first central bar in a fixed, operative position;

a second central bar shiftably mounted on the table for movement in a second plane and transverse to the first central bar into any one of a number of fixed, operative locations;

means releasably securing the second central bar in a fixed, operative location;

an actuatable power device for each central bar, respectively; and means attaching each power device on an outer end of the respective central bar, said attaching means having a post extending laterally from the plane of the respective central bar, and normally extending upwardly from the plane of said upper surface means of the table, each post having an attachment bracket shiftably mounted thereon for movement from a position substantially horizontally aligned with said upper surface means to a position above the plane of said upper surface means, whereby an elongated member can be coupled to the attachment means of each post and to a structural part mounted on the table for exerting a straightening force in any one of a number of different directions on the structural part itself when the respective power device is actuated.

2. Apparatus as set forth in claim 1, wherein said table has a pair of spaced first support members for shiftably supporting the first central bar and a pair of spaced second support members for shiftably supporting the second central bar.

3. Apparatus as set forth in claim 1, wherein said table has a number of spaced beams, each beam having an upper surface, the beams defining said mounting means for the structural part to be straightened.

4. Apparatus as set forth in claim 1, wherein said attaching means includes an extension bar on an outer end of each central bar, respectively, each post being pivotally mounted on and extending transversely of the respective extension bar, each power device being coupled to the respective extension bar and to the respective post.

5. Apparatus as set forth in claim 4, wherein is included means adjustably mounting the extension bar on the end of the respective central bar.

6. Apparatus as set forth in claim 1, wherein said table has a pair of front and rear support members, the first central bar spanning the distance between and being shiftably supported on said support members, one end of the first central bar projecting outwardly from the adjacent support member, there being an extension bar adjustably mounted on the outer end of the first central bar, the respective post being pivotally mounted on the outer end of the extension bar, the respective power device being coupled at one end to the post and at the other end to the extension bar.

7. Apparatus as set forth in claim 1, wherein the table has a pair of spaced side support members, said second central bar spanning the distance between and being shiftably supported on the side support members, the ends of the second central bar projecting outwardly from the side support members, each end of the second central bar having an extension bar thereon, each extension bar having a post pivotally mounted on the outer end thereof, and a power device spanning the distance between the adjustable mounting means and the post for pivoting the post relative to the extension bar.

8. Apparatus as set forth in claim 1, wherein said securing means includes pin means for adjustably securing the first and second central bars to the table.

9. Apparatus as set forth in claim 1, wherein said table has a pair of first gaps for receiving the first central bar and a pair of second gaps for receiving the second central bar, the planes of the central bars being adjacent horizontal planes.

10. Apparatus for straightening a structural part comprising:

a table;

means on the table for releasably mounting a structural part to be straightened;

a first central bar shiftably mounted on the table for movement in a first plane into any one of a number of fixed, operative positions;

means releasably securing the first central bar in a fixed, operative position;

a second central bar shiftably mounted on the table for movement in a second plane into any one of a number of fixed, operative locations;

means releasably securing the second central bar in a fixed, operative location;

an actuatable power device for each central bar, respectively; and means attaching each power device on an outer end of the respective central bar, said attaching means having a post extending laterally from the plane of the respective central bar, whereby an elongated member can be coupled to the post and to a structural part mounted on the table for exerting a straightening force on the structural part itself when the respective power device is actuated, said attaching means including an extension bar, a pair of abutting plates rotatable relative to each other for adjustably mounting the extension bar on the outer end of the respective central bar, and bolt means for releasably interconnecting the plates, each post being pivotally mounted on and extending transversely of the respective extension bar, each power device being coupled to the respective extension bar and to the respective post.

* * * * *